US005791585A

United States Patent [19]

Knight et al.

[11] Patent Number: 5,791,585

[45] Date of Patent: Aug. 11, 1998

[54] APPARATUS FOR MAINTAINING THE POSITION OF A ROTATING BOBBIN RELATIVE TO A TRANSFORMER CORE LEG

[76] Inventors: Michael W. Knight, 629 E. Vance St., Fuquay-Varina, N.C. 27526; Greg Lawrence, 1403 Waverly Rd. NW., Wilson, N.C. 27896; Gregory Link, 10632 Kingsclere Dr., Cary, N.C. 27511; James T. Tucker, 1008 Mingo Pl., Knightdale, N.C. 27545

[21] Appl. No.: 711,581

[22] Filed: Sep. 10, 1996

[51] Int. Cl.[6] ..... B65H 81/02; H01F 41/08

[52] U.S. Cl. ..... 242/434.7; 242/129.51; 242/596.7; 384/627; 29/605

[58] Field of Search ..... 242/434, 434.7, 242/596.7, 129.51; 384/627; 29/605

[56] References Cited

U.S. PATENT DOCUMENTS

| | | | |
|---|---|---|---|
| 4,325,045 | 4/1982 | Mehl . | |
| 4,500,215 | 2/1985 | Rusboldt | 284/627 X |
| 4,635,865 | 1/1987 | Arnold | 29/605 X |
| 4,638,554 | 1/1987 | Beisser | 29/605 |
| 4,649,640 | 3/1987 | Ito et al. | 29/605 |
| 5,398,401 | 3/1995 | Knight | 29/605 |
| 5,515,597 | 5/1996 | Herbst et al. . | |

FOREIGN PATENT DOCUMENTS

| | | | |
|---|---|---|---|
| 1379181 | 10/1964 | France | 384/627 |
| 2846555 | 5/1980 | Germany | 384/627 |
| 5121624 | 9/1980 | Japan | 242/434.7 |

*Primary Examiner*—Donald P. Walsh
*Assistant Examiner*—William A. Rivera
*Attorney, Agent, or Firm*—Larry I. Golden; David R. Stacey; Larry T. Shrout

[57] ABSTRACT

A bearing for maintaining a bobbin in relative position about a transformer core leg during the winding of a coil on the bobbin. The bearing is movable along the core leg such that a bearing surface of the bearing is positioned adjacent to but not touching each of two outwardly facing surfaces of two spaced apart flanges of the bobbin. The bearing surface is highly polished to reduce friction. The bearing surface preferably includes a circumferential ridge centered about the axis of the transformer core leg on which the bobbin is positioned. The outwardly facing surfaces of the two flanges each include a concentric groove shaped to complement the circumferential ridges of the bearing surfaces. When the bearing is in position the circumferential ridges are partially received within the concentric groove such that a small gap is maintained between the bearing surfaces and the outwardly facing surfaces. The bearing surface can also include ports for exhausting low pressure air into the space between the bearing surface and the outside surface of the bobbin flange. The low pressure air cools the bearing surface and acts as a cushion between the bearing and the bobbin flanges.

20 Claims, 7 Drawing Sheets

APPARATUS FOR MAINTAINING THE POSITION OF A ROTATING BOBBIN RELATIVE TO A TRANSFORMER CORE LEG

FIELD OF THE INVENTION

The present invention relates to the field of current transformers and particularly to an external bearing for positioning a coil bobbin during high speed spin winding of a fine wire coil.

BACKGROUND OF THE INVENTION

The art of winding coils is not new; however, the methods by which the coil bobbin is supported during the winding process has not been significantly improved. Coils wound on a one piece bobbin and which are slidably received onto a leg of a transformer core are easily supported by sliding onto a spindle which spins the bobbin during the winding process. It is now possible to wind coils on smaller transformers, however; core assembly, bobbin positioning and low winding speeds still pose problems which restrict winding technology. As seen in U.S. Pat. Nos. 4,325,045; 4,638,554 and 5,515,597, the means for positioning and driving the bobbin during the spin winding process has restricted the ultimate winding speed and the ability to install coil wire terminal pins of sufficient length for a direct printed circuit board connection prior to winding the coil. Thus separate operations for installing the coil or printed circuit board terminal pins in the bobbin, terminating the coil wire on the terminal pins and soldering the terminal connections are required after winding the coil. An alternate construction would involve installing terminating pin stubs prior to winding the coil and soldering terminal extensions onto the stubs after the coil winding process was complete. In either case extra steps are required to provide terminals of sufficient length for direct printed circuit board connections. These extra steps increase the production time for continuous lamination core transformers and therefore the cost of such transformers. It would therefore be desirable to have a cost efficient automated high speed spin winding process for the spin winding of small printed circuit board mountable coils on continuous lamination cores or closed magnetic cores.

SUMMARY OF THE INVENTION

The present invention provides a method of positioning and driving a spin winding coil bobbin about a leg of a continuous lamination core comprised of unassembled laminations or a solid magnetic core wherein coil wire terminals of sufficient length for direct printed circuit board connection can be installed prior to winding the coil. A two piece bobbin or split bobbing having two halves connected by an integral hinge is placed around one leg of the continuous lamination core and snapped together. The bobbin includes first and second flanges separated by a tubular bobbin base. Each flange includes an outside surface having a concentric groove. The first flange also includes a circumferential gear integrally formed from the outside surface such that a driving gear can be engaged for rotating the bobbin at high speed. Coil terminal pins are supportably pressed into passages located in each half of the second bobbin flange such that the pins assist in holding the two halves of the bobbin together. The terminal pins are supportably pressed through the bobbin second flange such that the midpoint of each terminal pin is coincident with the mating line of the two bobbin halves thereby permitting the bobbin and inserted terminal pins to rotate freely about the core leg and within the core window. The transformer core with coil bobbin installed is placed in a winding fixture which holds the core to prevent movement during the winding process. Two bobbin bearings are moved into position such that one is immediately adjacent the outside surface of each of the two bobbin flanges. Each bobbin bearing includes a bearing surface having circumferential ridge shaped to conform with and be received partially within the concentric groove of the bobbin flanges. The bearing surfaces of the bobbin bearings remain slightly spaced apart from the outside surfaces of the bobbin flanges. As the coil winding process starts a wire feeder skeins the free end of the coil wire, i.e. multiple strands of wire are twisted together for additional strength, and wraps the skeined end around one of the coil wire terminal pins. The drive wheel engages the gear of the first bobbin flange and begins to rotate the bobbin at a high speed thus pulling coil wire from the coil wire feeder as the bobbin rotates. The wire feeder guides the wire back and forth across the bobbin producing a uniformly wound coil. As the desired number of revolutions is approached the bobbin speed is quickly slowed and stopped within a few revolutions. The wire feeder skeins a portion of the wire between the bobbin and the wire feeder, wraps the skeined portion around the other coil wire terminal, and cuts the wire. The transformer is removed from the winding fixture and the wire terminal pins are supportably pushed into one side of the second bobbin flange such that the desired length of terminal pin extends outward from the opposite side of the second bobbin flange. The method of spin winding a coil about a continuous lamination current transformer core using the bearing of the present invention is described in greater detail in the concurrently filed Patent Applications RLC-41 entitled METHOD FOR HIGH SPEED SPIN WINDING OF A COIL ABOUT A CONTINUOUS LAMINATION CORE, Ser. No. 08/711,640; and RLC-45 entitled METHOD FOR ASSEMBLING A THREE PHASE CURRENT TRANSFORMER Ser. No. 08/707,938, which are incorporated herein by reference.

Other features and advantages of the invention will become apparent to those skilled in the art upon review of the following detailed description, drawings and claims.

Figure 1:
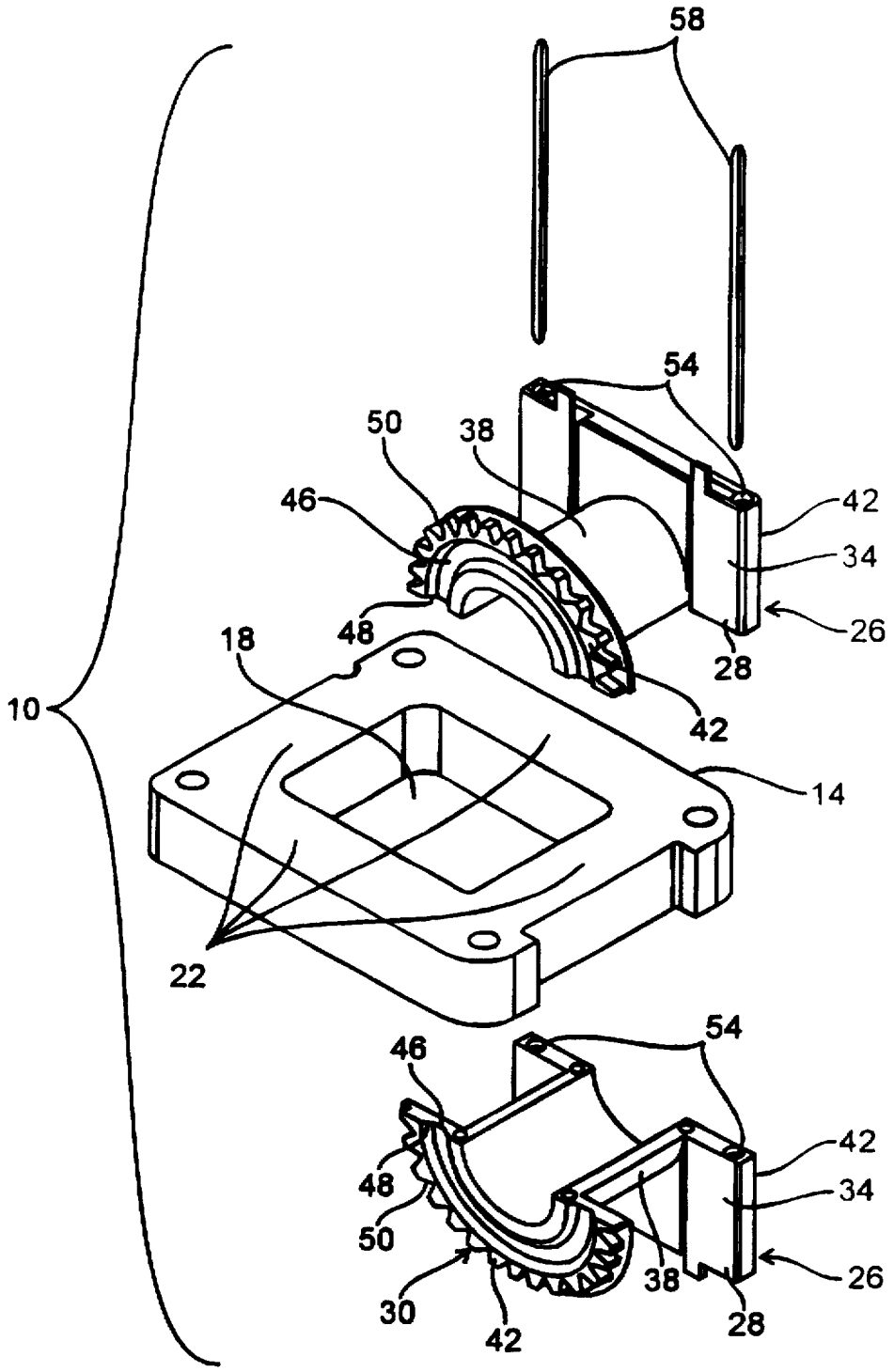
FIG. 1 is an exploded view of a solid or continuous lamination core and a two piece bobbin with printed circuit board terminal pins in accordance with the present invention.

Before one embodiment of the invention is explained in detail, it is to be understood that the invention is not limited in its application to the details of construction and description as illustrated in the drawings. The invention is capable of other embodiments and of being practiced or being carried out in various other ways. Also, it is to be understood that the phraseology and terminology used herein is for the purpose of description and should not be regarded as limiting.

DESCRIPTION OF THE PREFERRED EMBODIMENT

Figure 5:
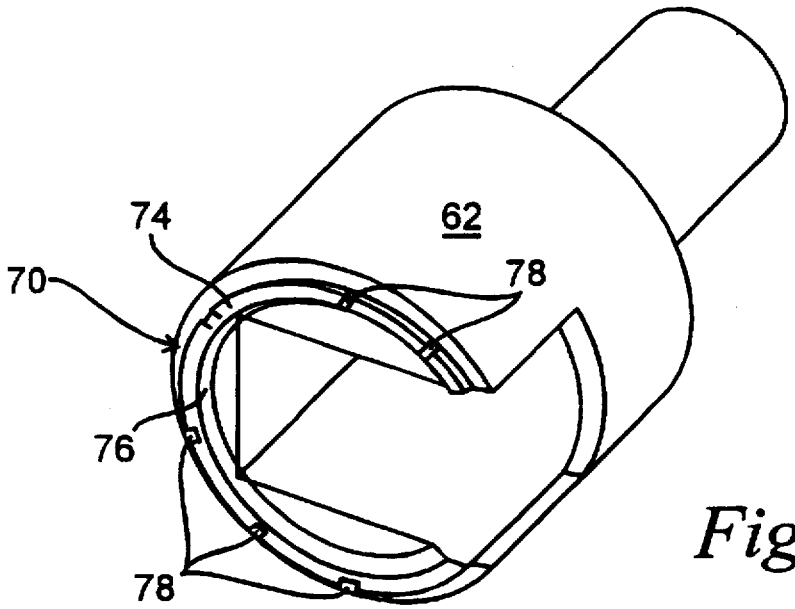
FIG. 5 is an isometric view of the bobbin bearing showing the bearing surface in accordance with the present invention.

FIG. 1 illustrates an exploded view of a continuous lamination core transformer having a high speed spin wound coil in accordance with the present invention and generally indicated by reference numeral 10. The transformer 10 includes a continuous lamination core 14 having a window 18 defined by the integral core legs 22. The core 14 may be generally square or rectangular in shape such that the window 18 defined by the core 14 is also either generally square or rectangular in shape. The transformer 10 also includes a bobbin 26 installed about one of the core legs 22 on which the coil will be wound. The bobbin 26 can be made from two halves 28 which are assembled about one of the legs 22. The bobbin 26 can also be constructed of a single molded piece having an integral hinge joining two similarly shaped halves. In the preferred embodiment the bobbin halves 28 are provided with integrally formed means for being snapped together when installed on the core leg 22. The bobbin 26 includes a first flange 30 which is generally circular in shape and a second flange 34 which is generally square in shape. The first and second flanges, 30 and 34 respectively, extend outwardly from and generally perpendicularly to a generally tubular bobbin base 38 which spaces the two flanges 30 and 34 apart. The tubular bobbin base 38 defines a passage 40 having an inside diameter dimensioned such that the bobbin 26 can rotate freely about the leg 22 of the transformer core 14. Each of the first and second flanges, 30 and 34 respectively, include an outwardly facing surface 42. A concentric groove 46 having a beveled inside surface 48 is defined in each of the outwardly facing surfaces 42. A circumferential gear 50 is also defined in the outwardly facing surface 42 of the first flange 30. The second flange 34 defines two passages 54 being generally parallel to one another and passing through the flange 34 such that a generally equal portion of each passage 54 is defined in each half 28 of the flange 34. Each of the passages 54 is dimensioned to snugly receive a printed circuit board terminal pin 58 which functions as a terminal for the coil wire and an electrical connection to a printed circuit board as shown in FIG. 5. The printed circuit board terminal pins 58 also help to secure the two bobbing halves 28 together during the coil winding process.

The bobbin 26 is installed on the selected core leg 22 by placing one bobbin half 28 on one side of the selected core leg 22 and the other bobbin half 28 on the other side of the selected leg 22 such that flanges 30 and 34 of each half 28 are properly aligned and then snapping the two halves 28 together. The passages 54 in the each of the two halves 28 of the second flange 34 will be aligned such that they pass completely through the second flange 34.

Figure 2:
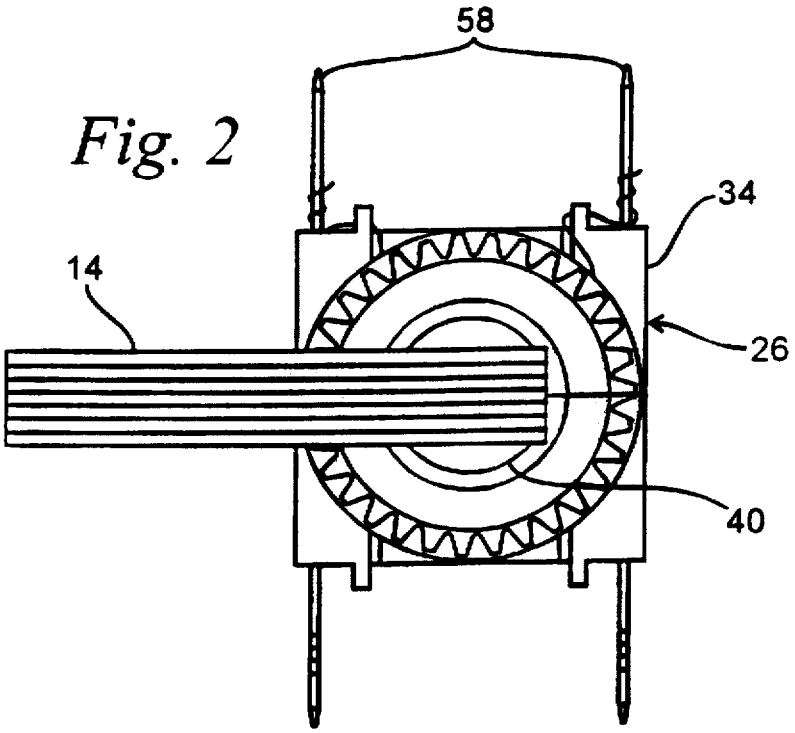
FIG. 2 is a side view of an assembled transformer with printed circuit board terminal pins in the winding position in accordance with the present invention.
Figure 3:
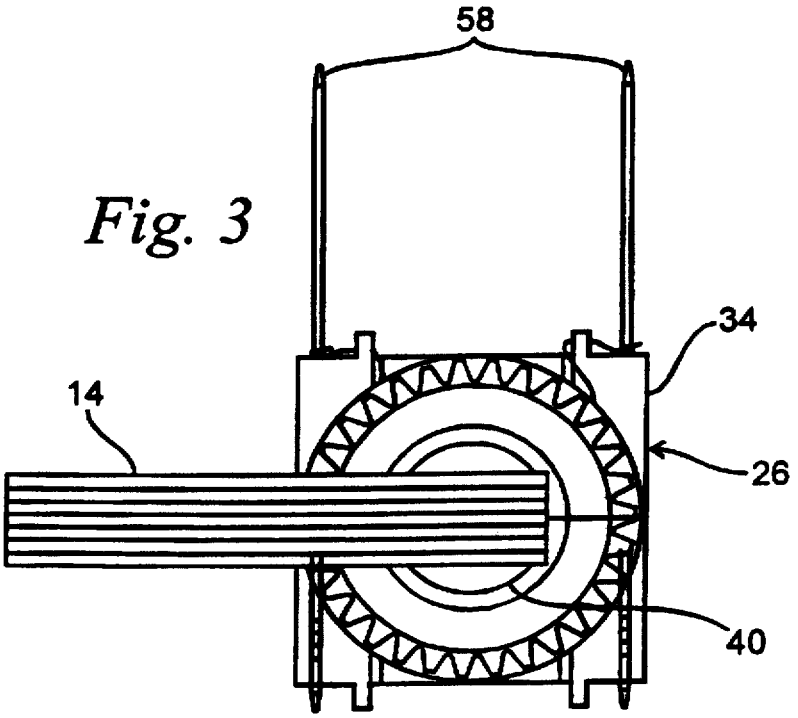
FIG. 3 is a side view of an assembled transformer with printed circuit board terminal pins in the extended printed circuit board mounting position in accordance with the present invention.

The core 14 with attached bobbin 26 is placed into a fixture wherein a printed circuit board terminal pin 58 is supportably pressed into each of the two passages 54. The printed circuit board terminal spins 58 are supported along their length during the insertion process to prevent buckling. When properly inserted, the midpoint of each printed circuit board terminal pin 58 should coincide with the mating line of the two bobbin halves 28 thereby permitting the bobbin 26 with inserted printed circuit board terminal pins 58 to rotate freely about the core leg 22 and within the core window 18, as shown in FIG. 2.

Figure 4:
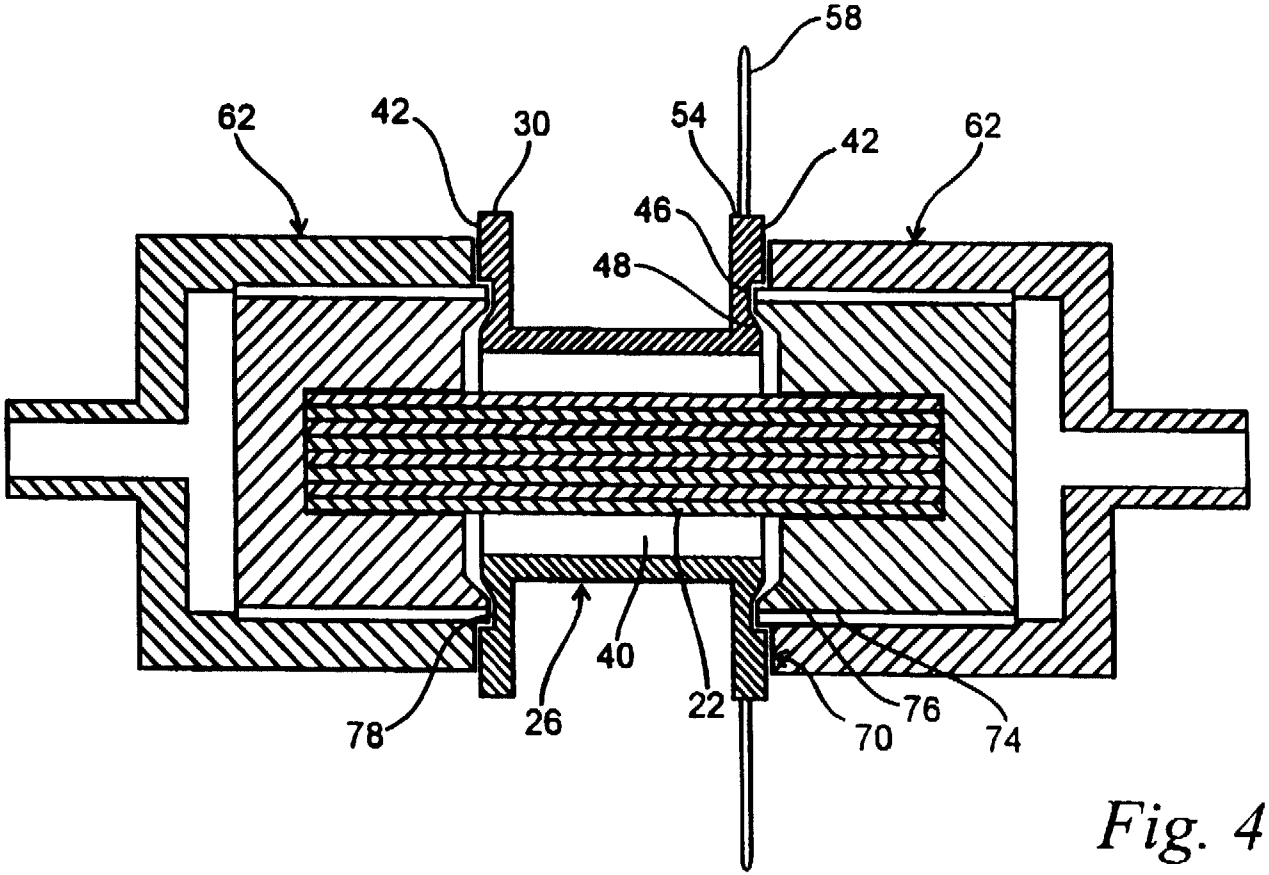
FIG. 4 is a cross-sectional view of a core leg with assembled bobbin and bobbin bearings in place.

The transformer core 14 with coil bobbin 26 installed is placed into a winding fixture which firmly holds the core 14 to prevent movement during the winding process. As shown in FIG. 4, two bobbin bearings 62 are positioned such that one is immediately adjacent each of the outwardly facing surface 42 of each of the two bobbin flanges 30 and 34. As shown in FIG. 5, each of the bobbin bearings 62 have a relief 66 which is dimensioned to slidably receive a portion of the transformer core 14 immediately adjacent the bobbin flanges 30 and 34. The reliefs 66 provide proper positioning of the bearings 62 with respect to the axis of the leg 22 about which the bobbin 26 is to rotate. The relief 66 also assists in holding the unassembled laminations of the core 14 in position during the winding process. Each bearing 62 also includes a bearing surface 70 which has an outwardly extending circumferential ridge 74 with a beveled inside surface 76. The circumferential ridges 74 are formed such that they are complementary to the concentric grooves 46 in the flanges 30 and 34. The beveled inside surfaces 48 of the grooves 46 and the beveled inside surfaces 76 of the ridges 74 assist in centering the bobbin 26 about the core leg 22. Each bearing surface 70 and its circumferential ridge 74 is highly polished to reduce friction between the bearing surfaces 70 and the outwardly facing surfaces 42 of the flanges 30 and 34 during the high speed spin winding process.

When the bobbin bearings 62 are properly positioned the circumferential ridges 74 will be centered about the axis of the core leg 22 and partially received within the concentric grooves 46 of the bobbin flanges 30 and 34. A small gap is maintained between the bearing surfaces 70 of the bobbin bearings 62 and the outwardly facing surfaces 42 of the bobbin flanges 30 and 34. The bearing surfaces 70 are provided with small ports 78 for exhausting low pressure air into the small gap between the bearing surfaces 70 and the outwardly facing surfaces 42 of the bobbin flanges 30 and 34. The flow of low pressure air acts both as a coolant for the bearing surfaces 70 and a cushion between the bearing surfaces 70 and the outwardly facing surfaces 42 of the bobbin flanges 30 and 34 during the high speed spin winding process.

As the coil winding process starts a drive gear engages the circumferential gear 50 on the first flange 30 of the bobbin 26. The bobbin 26 is rotated to an index position wherein the terminal pins 58 are in a known position. Since a fine coil wire is being wound on the bobbin 26 it is preferred that the leading and trailing ends be skeined, i.e. multiple strands of wire are twisted together for additional strength. The skeining is done by a coil wire feeder which also terminates the leading end of the coil wire by wrapping the skeined wire end around one of the printed circuit board terminal pins 58. After terminating the coil wire, the coil wire feeder moves to the starting position over the bobbin base 38 as the drive gear begins rotating the bobbin 26 at a high speed. As the bobbin rotates coil wire is pulled from the coil wire feeder which moves back and forth between the first and second bobbin flanges, 30 and 34 respectively, thereby producing a uniformly wound coil. As the desired number of revolutions is approached the bobbin speed is quickly slowed to a stop within a few revolutions. The wire feeder skeins a portion of the terminating end of the coil wire, wraps the skeined terminating end around the other printed circuit board terminal pin 58, and cuts the wire, leaving enough of the skeined wire to terminate the leading end of the next coil to be wound. The transformer is removed from the winding fixture and the printed circuit board terminal pins 58 are supportably pushed into one side of the bobbin flange 34 such that the desired length of printed circuit board terminal pin 58 extends outward from the opposite side of the second bobbin flange 34. Using this process the time required to assemble the bobbin 26 on the core leg 22 and wind an 8,000 turn fine wire coil on the bobbin is approximately 90 seconds.

Figure 8:
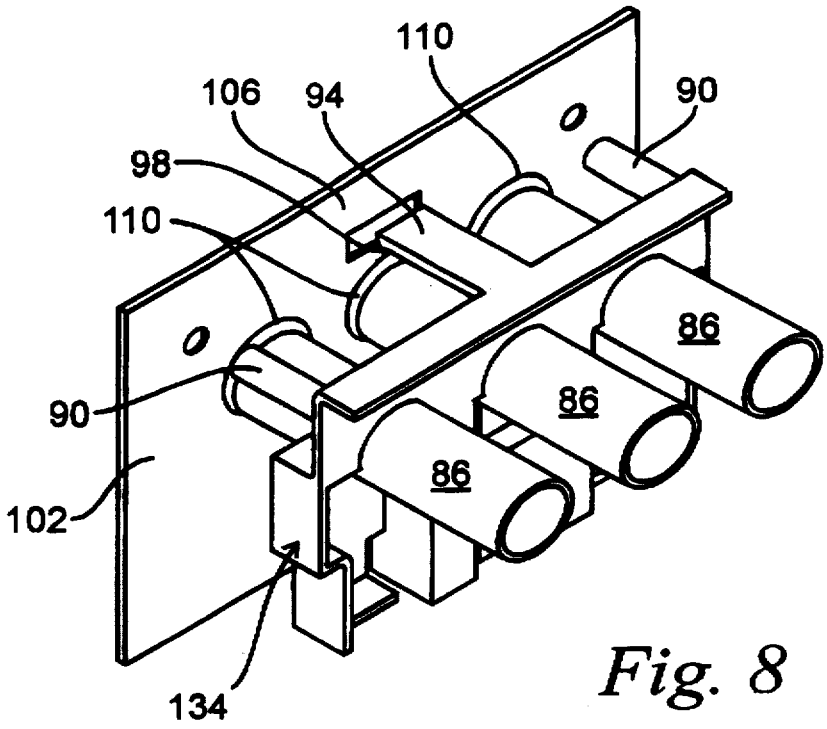
FIG. 8 is an isometric view of a three phase transformer carrier in accordance with the present invention.
Figure 6:
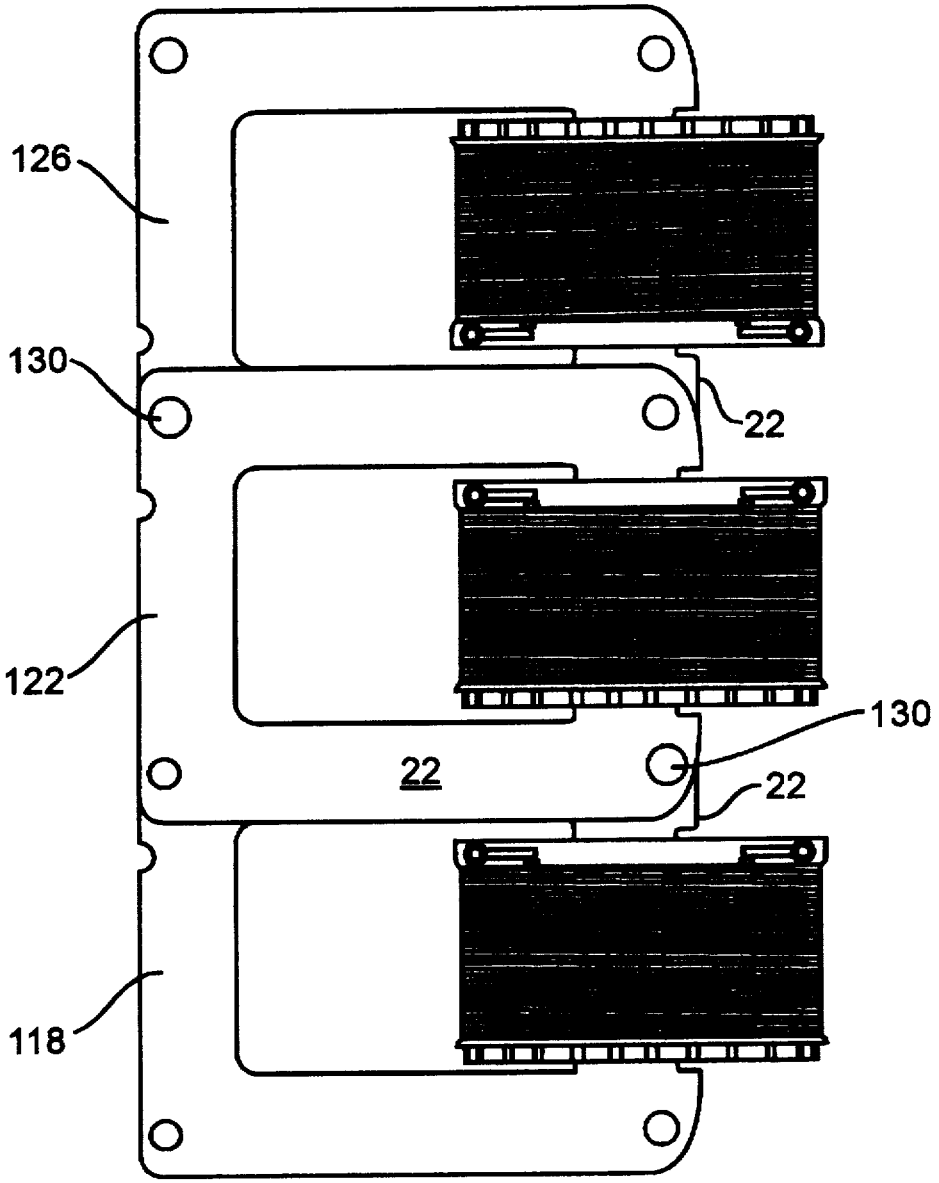
FIG. 6 is a top view of an assembled three phase transformer in accordance with the present invention.
Figure 7:
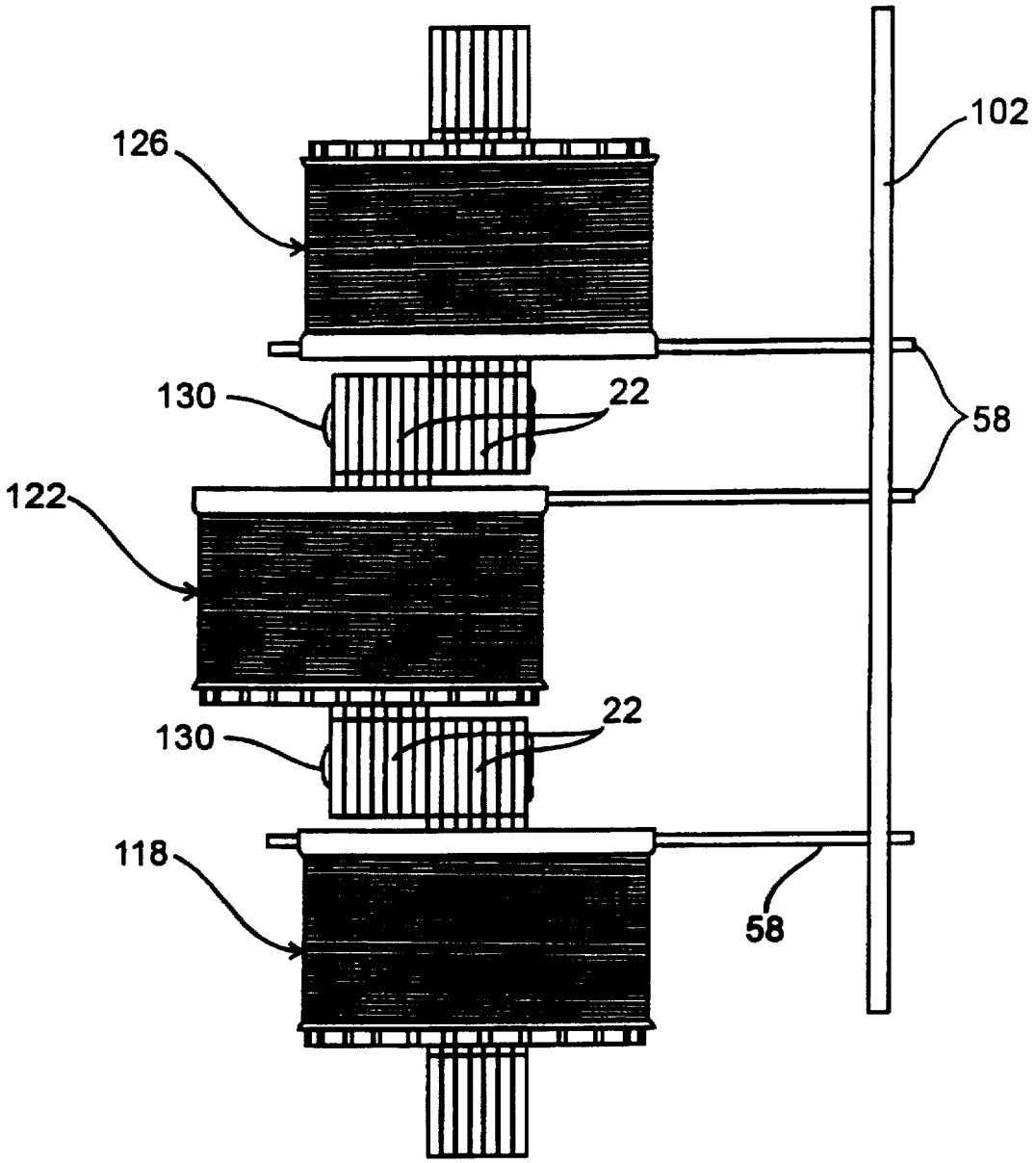
FIG. 7 is a front view of a three phase transformers assembled in accordance with the present invention and electrically connected to a common printed circuit board by printed circuit board terminals.
Figure 9:
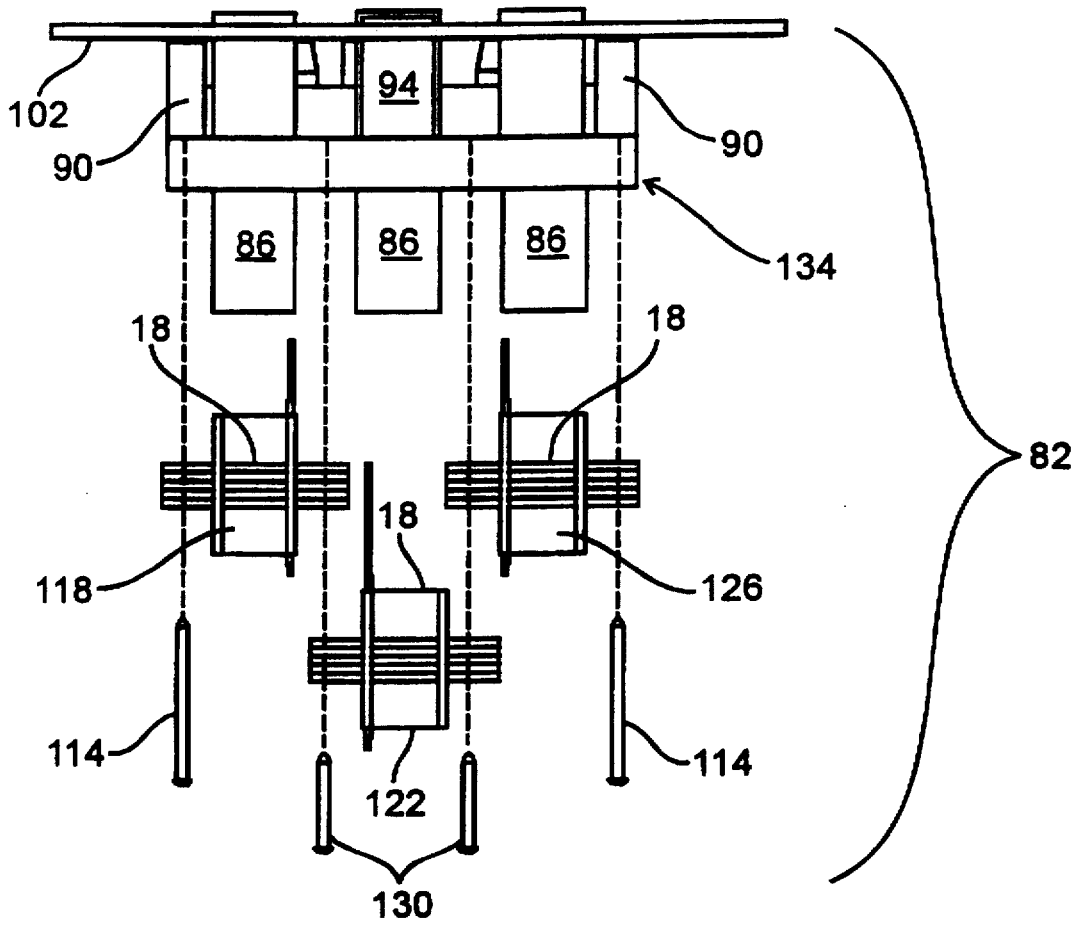
FIG. 9 is an exploded view of a three phase transformer assembly with transformer carrier in accordance with the present invention.

As shown in FIGS. 6 and 7, a three phase transformer can be made by taking three transformers 118, 122 and 126, each assembled in the same manner as transformer 10 described above, and placing them side-by-side such that the core legs 22 adjacent the bobbin 26 of the center transformer 66 overlap the inside core legs 22 of the two outside transformers 62 and 70. The overlapped legs 22 of the three transformer cores 14 are fixed together by mechanical fasteners such as rivets 130 or similar fasteners. In the preferred embodiment a molded transformer carrier 134, as shown in FIGS. 8 and 9, will form the base for a three phase transformer assembly 82. The transformer carrier 78 is preferably made from an electrically insulating material and defines three tubes 86 which will receive the electrical conductors of the primary circuit. The transformers 118, 122, and 126, are individually placed into the transformer carrier 134 such that the window 18 of each of the three adjacent transformers 118, 122 and 126 will receive one of the tubes 86. The transformer carrier also defines a number of stand-off sleeves 90, some of which will receive the printed circuit board terminals 58 as the transformers 118, 122 and 126 are placed into the transformer carrier 134. The overlapped core legs 22 of the transformers 118, 122 and 126 are simultaneously riveted together and to the transformer carrier 134 by the rivets 74 thus forming the preferred three phase transformer assembly 82. The transformer carrier 134 also includes a pair of integrally formed generally parallel retainers 94, each having an inwardly facing flange 98 at its distal end. The retainers 94, in cooperation with the stand-off sleeves 90 permit the transformer carrier 134 to be snappingly attached to a printed circuit board 102. The retainers 94 are received within a pair of holes 106 defined by the printed circuit board 102 such that the flanges 98 engage one side of the printed circuit board 102 as the distal ends of the stand-off sleeves 90 engage the other side, thereby captivating the board 102 between the flanges 98 and the stand-off sleeves 90. The printed circuit board 102 also defines holes 110 for receiving the tubes 86 as the transformer assembly 82 is snapped onto the printed circuit board 102. After snapping the transformer assembly 82 in place on the printed circuit board 102 longer rivets 114 are passed through the laminations of the two outside transformers 118 and 126, the stand-off sleeves 90 and the printed circuit board 102. As electrical components are wave soldered to the printed circuit board 102 the printed circuit board terminals 58 and rivets 114 are also soldered to the printed circuit board 102 thus fixing the transformer assembly 82 to the printed circuit board 102. It may also be desirable to place an adhesive between the transformer coils and the transformer carrier 134 for additional protection against vibration and shock.

We claim:

1. An apparatus for maintaining the position of a bobbin relative to a transformer core leg about which the bobbin will spin while winding a coil on the bobbin, said apparatus comprising:

a first bearing having a means for positioning said first bearing and being adapted to be slidably moved along the transformer core leg to a position wherein said first bearing is in juxtaposed position with an outside surface of a first bobbin flange; and a second bearing having a means for positioning said second bearing and being adapted to be slidably moved along the transformer core leg to a position wherein said second bearing is in juxtaposed position with an outside surface of a second bobbin flange.

2. The apparatus of claim 1 wherein said first and second bearings each have a bearing surface facing said first and second flanges respectively.

3. The apparatus of claim 2 wherein each said bearing surface is polished to reduce friction.

4. The apparatus of claim 2 wherein said bearing surfaces of said first and second bearings each include a circumferential ridge extending outward from said bearing surface, said circumferential ridges being centered about an axis of the transformer core leg passing through the bobbin.

5. The apparatus of claim 4 wherein said first and second bobbin flanges each include concentric grooves shaped to complement said circumferential ridges of said first and second bearings and for partially receiving said circumferential ridges.

6. The apparatus of claim 5 wherein said circumferential ridges and said concentric grooves each have a beveled inside surface to improve the centering of the bobbin about the axis of the transformer core leg.

7. The apparatus of claim 4 wherein said bearing surfaces of said first and second bearings further include ports for exhausting air under low pressure to provide a cooling cushion between said bearing surfaces and said flanges.

8. An apparatus for maintaining the position of a bobbin relative to a transformer core leg during high speed spin winding of a coil, said apparatus comprising:

a first bearing being adapted to slidably move along the transformer core leg to a position wherein a bearing surface of said first bearing is in juxtaposed position with an outside surface of a first bobbin flange;

a second bearing being adapted to slidably move along the transformer core leg to a position wherein a bearing surface of said second bearing is in juxtaposed position with an outside surface of a second bobbin flange;

said first and second bearings having a relief for receiving a portion of the transformer core immediately adjacent said first and second flanges of the bobbin such that said first and second bearings are centered on the core leg.

9. The apparatus of claim 8 wherein said bearing surface is polished to reduce friction.

10. The apparatus of claim 8 wherein said bearing surfaces of said first and second bearings each include a circumferential ridge.

11. The apparatus of claim 10 wherein said first and second bobbin flanges each include concentric grooves shaped to complement said circumferential ridges of said first and second bearings and for partially receiving said circumferential ridges.

12. The apparatus of claim 11 wherein said circumferential ridges and said concentric grooves each have a beveled inside surface to improve the centering of the bobbin about the transformer core leg.

13. The apparatus of claim 8 wherein said bearing surfaces of said first and second bearings further include ports for exhausting air under low pressure to provide a cooling cushion between said bearing surfaces and said flanges.

14. An apparatus for maintaining the position of a rotating bobbin with respect to a continuous lamination transformer core leg during a coil winding process, said apparatus comprising:

a first bearing having a bearing surface and a means for positioning said first bearing, said first bearing being adapted to slidably move along the transformer core leg to a position wherein said bearing surface of said first bearing is immediately adjacent an outside surface of a first bobbin flange; and a second bearing having a bearing surface and a means for positioning said second bearing, said second bearing being adapted to slidably move along the transformer core leg to a position wherein said bearing surface of said second bearing is immediately adjacent an outside surface of a second bobbin flange; said first and second bearing thereby maintaining said bobbin in a position relative to the transformer core leg while a coil is being spin wound on said bobbin.

15. The apparatus of claim 14 wherein said outside surfaces of said first and second bobbin flanges each define a concentric groove and said bearing surfaces of said first and second bearings each define an outwardly extending circumferential ridge shaped to complement said concentric grooves of said bobbin flanges, said circumferential ridges of said bearing surfaces being partially received within said concentric grooves of said bobbin flanges when said first and second bearings are immediately adjacent said first and second bobbin flanges respectively.

16. The apparatus of claim 15 wherein said circumferential ridges and said concentric grooves each have a beveled surface to improve the centering of the bobbin about the axis of the transformer core leg.

17. The apparatus of claim 14 wherein said bearing surfaces of said first and second bearings further include ports for exhausting low pressure air into a space between said bearing surfaces and said bobbin flanges for providing a cooling cushion between said bearing surfaces and said bobbin flanges.

18. An apparatus for maintaining the position of a rotating bobbin relative to a continuous lamination transformer core leg during a coil winding process, said apparatus comprising:

a first bearing defining a relief for receiving a portion of the transformer core such that said first bearing can slidably move along the transformer core leg to a position wherein a polished bearing surface of said first bearing is immediately adjacent an outside surface of a first bobbin flange; and a second bearing defining a relief for receiving a portion of the transformer core such that said second bearing can slidably move along the transformer core leg to a position wherein a polished bearing surface of said second bearing is immediately adjacent an outside surface of a second bobbin flange, said bearing surface of said first bearing being in opposed relationship to said bearing surface of said second bearing such that said bobbin is maintained between said first and second bearings in a position relative to the transformer core leg suitable for spin winding a coil on said bobbin.

19. The apparatus of claim 18 wherein said outside surfaces of said first and second bobbin flanges each define a concentric groove and said bearing surfaces of said first and second bearings each define a circumferential ridge, said circumferential ridges being shaped to complement said concentric grooves of said bobbin flanges such that said circumferential ridges are partially received within said concentric grooves when said bearing surfaces of said first and second bearings are immediately adjacent said first and second bobbin flanges.

20. The apparatus of claim 19 wherein said bearing surfaces of said first and second bearings further include ports for exhausting low pressure air into a space between said bearing surfaces and said bobbin flanges for providing a cooling cushion between said bearing surfaces and said bobbin flanges.

* * * * *